US008166941B2

(12) United States Patent
Werler

(10) Patent No.: US 8,166,941 B2
(45) Date of Patent: May 1, 2012

(54) DEVICE FOR SWITCHING ACTIVATION OF A HYDRAULIC VALVE PLAY EQUALIZATION ELEMENT

(75) Inventor: Andreas Werler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 335 days.

(21) Appl. No.: 12/657,241

(22) Filed: Jan. 15, 2010

(65) Prior Publication Data

US 2010/0186691 A1 Jul. 29, 2010

(30) Foreign Application Priority Data

Jan. 28, 2009 (DE) ..... 10 2009 006 894

(51) Int. Cl.
*F01L 1/14* (2006.01)

(52) U.S. Cl. ..... 123/90.48; 123/90.52; 123/90.16

(58) Field of Classification Search ..... 123/90.48, 123/90.52, 90.16
See application file for complete search history.

(56) References Cited

U.S. PATENT DOCUMENTS

| | | | | |
|---|---|---|---|---|
| 6,497,207 | B2 * | 12/2002 | Spath et al. | 123/90.16 |
| 2007/0199529 | A1 | 8/2007 | Deane | |

FOREIGN PATENT DOCUMENTS

| | | |
|---|---|---|
| DE | 369 394 | 2/1923 |
| DE | 197 30 814 | 1/1999 |
| DE | 10 2007 010 156 | 9/2008 |
| DE | 10 2007 033 757 | 1/2009 |
| EP | 1 136 664 | 9/2001 |
| EP | 1 493 902 | 1/2005 |
| EP | 1 522 683 | 4/2005 |

* cited by examiner

*Primary Examiner* — Zelalem Eshete
(74) *Attorney, Agent, or Firm* — Collard & Roe, P.C.

(57) ABSTRACT

A device for switching activation of a hydraulic valve play equalization element for setting of a maximal stroke or a zero stroke on a valve of an internal combustion engine, has a switching element for locking and unlocking the housing of the valve play equalization element relative to a guide that is axially displaceable therein. The switching element is a switching ring that surrounds the housing, on which a linkage for rotating the switching ring relative to the housing is disposed. The linkage of the switching ring is connected via a guide element with a groove on the circumference of a rotatable adjustment shaft. The groove has a groove section demonstrating an axial incline, and in which the switching ring is rotated, to implement a switching process via the guide element during rotation the adjustment shaft.

11 Claims, 2 Drawing Sheets

DEVICE FOR SWITCHING ACTIVATION OF A HYDRAULIC VALVE PLAY EQUALIZATION ELEMENT

CROSS REFERENCE TO RELATED APPLICATIONS

Applicant claims priority under 35 U.S.C. 119 of German Application No. 10 2009 006 894.5 filed Jan. 28, 2009.

BACKGROUND OF THE INVENTION

1. Field of the Invention

The invention relates to a device for switching activation of a hydraulic valve play equalization element for optional setting of a maximal stroke or a zero stroke on a valve of an internal combustion engine.

2. The Prior Art

The invention is preferably used for a hydraulic valve play equalization element such as described in German Patent Application No. DE 10 2007 033 757 A1. In this connection, the valve drive for an internal combustion engine consists of a drag lever impacted by a cam. One end of the lever is connected with a gas exchange valve, and the other end of the lever is mounted on a valve play equalization element. Optionally, a maximal stroke or a minimal stroke is adjusted on the valve of the internal combustion engine, by turning the support of the drag lever on or off by the hydraulic play equalization element. In order to be able to implement a zero stroke, i.e. a cylinder shut-off, or a minimal valve stroke in the case of this valve drive, the support of the drag lever on the valve play equalization element is unlocked. Unlocking and locking of the valve play equalization element takes place by way of a rotating switching ring that surrounds the housing and is connected with balls disposed in bores in the housing, which balls can be displaced by the switching ring. For locking, the balls are pressed into a groove disposed in the guide, by the inner wall of the switching ring during rotation of the switching ring, so that the housing with the guide situated in it is locked in place by the balls. On the inside of the switching ring, recesses are disposed that are brought into agreement and aligned with the bores in the housing, for unlocking the housing relative to the guide, by rotating the switching ring, so that the balls are pressed into the recesses of the switching ring. In this connection, an adjustment device for activating the switching ring was not described.

A valve drive for internal combustion engines is also described in German Patent Application No. DE 197 30 814 A1, in which a switching means for optional switching of the stroke valve between a maximal stroke and a zero or minimal stroke is disposed in the support element of the drag lever. The switching means consists of a rod that can be displaced by a displacement means, by way of which rod the support element is locked or unlocked.

A disadvantage of this solution is the complicated guidance and placement of the switching means in the housing of the internal combustion engine.

European Patent Application No. EP 1 493 902 A1 describes a device for valve shut-off, in which the valve switching is activated by way of a controlled oil feed. In this connection, the oil feed is regulated by rotating a control piece. Rotation of the outer control piece takes place by way of a gear rack that engages an outer gearing disposed on the control piece.

A disadvantage of this solution is the great effort for rotation of the control piece. Furthermore, it is also difficult to implement individual shut-off of individual valves.

SUMMARY OF THE INVENTION

It is therefore an object of the invention to provide a device for switching activation of a hydraulic valve play equalization element, for optional setting of a maximal stroke or a zero or minimal stroke on a valve of an internal combustion engine, which is simple to construct and operate, and with which the support function of one or more valve play equalization elements disposed in series can optionally be turned on or off.

According to the invention, this object is accomplished by a device for switching activation of a hydraulic valve play equalization element for optional setting of a maximal stroke or a zero stroke on a valve of an internal combustion engine. The hydraulic valve play equalization element has a switching element for locking and unlocking the housing of the valve play equalization element with regard to a guide that is axially displaceable within the housing. The switching element consists of a rotatable switching ring that surrounds the housing, on which a linkage for an adjustment device, for rotating the switching ring relative to the housing, is disposed. Turning the support function of the equalization element on and off takes place in that the linkage of the switching ring is connected, by way of a guide element, with a groove that is disposed on the circumference of a rotatable adjustment shaft. The groove has a groove section demonstrating an axial incline, and in which the switching ring is rotated, to implement a switching process by means of the guide element during rotation the adjustment shaft.

The advantage of the solution according to the invention is that the switching process can be carried out with simple means and in a precisely controllable manner.

In one embodiment of the invention, multiple valve play equalization elements disposed in series in the cylinder block can be optionally turned on and off by multiple grooves disposed on the adjustment shaft. In the event of turn-on or shut-off of multiple valve play equalization elements disposed in series, the individual groove sections that demonstrate an axial incline are disposed on the circumference of the adjustment shaft, offset relative to one another. Turn-on or shut-off of the individual valve play equalization elements takes place by turning the adjustment shaft forward or back.

In one embodiment, the ends of the each groove section that demonstrates an axial incline make a transition into a radial groove section. The incline of the groove section can proportionally correspond to the angle of rotation for rotating the switching ring.

Preferably, the groove is disposed on the adjustment shaft or on the surface of a sleeve that is firmly connected with the adjustment shaft. The adjustment shaft preferably can be adjusted in both directions of rotation, in a controlled manner. Each groove can consist of not only the radial groove sections but also of two groove sections that demonstrate an axial incline, which are each separated by a radial groove section, and whereby the incline of the two groove sections is disposed in opposite directions.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
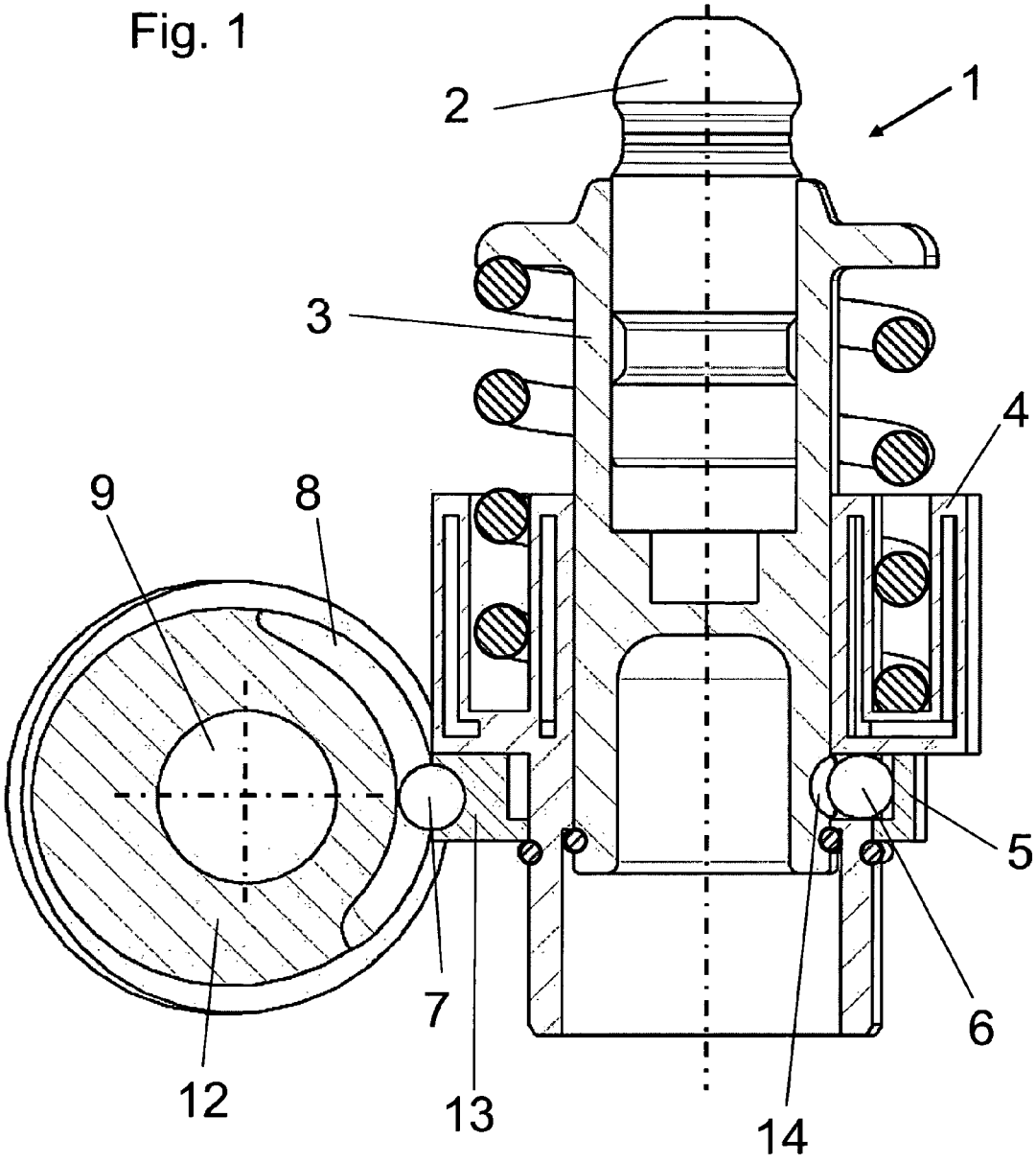
FIG. 1 shows a schematic sectional representation of a hydraulic valve play equalization element with an adjustment shaft for switching activation of the valve play equalization element.

The invention will be explained using a valve play equalization element 1 such as that described in German Patent Application No. DE 10 2007 033 757 A1, the disclosure of which is herein incorporated by reference. In this connection, all the characteristics described in DE 10 2007 033 757 A1 can also be applied to the switching activation according to the invention. In FIG. 1, valve play equalization element 1 is shown with the device according to the invention for switching activation of valve play equalization element 1. However, it is understood that the invention can also be used for other switchable valve play equalization elements.

Hydraulic valve play equalization element 1, which is disposed in a valve control drive of an internal combustion engine, which drive is not shown and is known, consists of a housing 4, in which a guide 3 is disposed, which can be displaced in the axial direction, counter to the force of a spring. An axially displaceable support piston 2 of valve play equalization element 1 is disposed in guide 3. The switching element for locking and unlocking housing 4, with guide 3 of valve play equalization element 1 disposed in it in an axially movable manner, consists of a rotating switching ring 5 provided with recesses, which ring is connected with switching balls 6 guided in bores 14 of the housing 4. Switching ring 5 is disposed on the outer circumference of housing 4, so as to rotate, specifically below the accommodation for the spring, in such a manner that it covers bores 14 in housing, 4 of valve play equalization element 1. The recesses are disposed on the inside of switching ring 5, and correspond, if the switching ring 5 is positioned accordingly, with bores 14 disposed in housing 4 and radially penetrating housing 4. The recesses have the shape of switching balls 6 that are displaceable in bores 14, whereby only a part of the ball circumference can be accommodated in the recesses. To rotate switching ring 5, it is provided with a linkage 13 for a corresponding adjustment device. Valve shut-off takes place by rotating switching ring 5, thereby canceling out the locking between housing 4 and guide 3. For unlocking, switching ring 5 is rotated until bores 14 in housing 4 agree and align with the recesses. When this position is reached, switching balls 6 are pressed out of the groove and in the direction of the recess, and accommodated there, by means of the force that is transferred to guide 3 from the pivoting movement of the drag lever and by way of support piston 2. Locking of housing 4 with guide 3 by means of switching balls 6 is thereby cancelled out. Guide 3, with the support piston 2 disposed in it, can thus slide axially in housing 4 in accordance with the pivoting movements of the drag lever. For the remainder, reference is made to the explanations in DE 10 2007 033 757 A1.

According to the invention, for rotation of switching ring 5 and thus for switching activation of hydraulic valve play equalization element 1, for optional setting of a maximal stroke or a zero stroke on a valve of an internal combustion engine, linkage 13 of switching ring 5 of valve play equalization element 1 is in communication with a groove 8 disposed on the circumference of an adjustment shaft 9 mounted so as to rotate, by way of a guide element 7. Groove 8 has a groove section 11 that demonstrates an axial incline, which section rotates switching ring 5 of valve play equalization element 1, to implement a switching process, when adjustment shaft 9 is rotated, and thus guide element 7 runs through groove section 11. Groove section 11 that demonstrates an axial incline is delimited by a radial groove section 10, and thus forms groove 8, in total (See FIG. 3).

In this connection, groove 8 can be disposed directly on the circumference of adjustment shaft 9, or, for reasons of production technology, on the surface of a sleeve 12 that is firmly connected with adjustment shaft 9. The axial incline of groove section 11 on the surface of adjustment shaft 9 or sleeve 12 is configured so that when adjustment shaft 9 is rotated, and when guide element 7 passes through groove section 11, switching ring 5 is rotated between two switching positions.

It has proven to be particularly advantageous to configure guide element 7 that is articulated onto linkage 13 of switching ring 5 and is connected with groove 8, as a ball. By using a ball, the friction between the ball and groove 8 is reduced.

Figure 2:
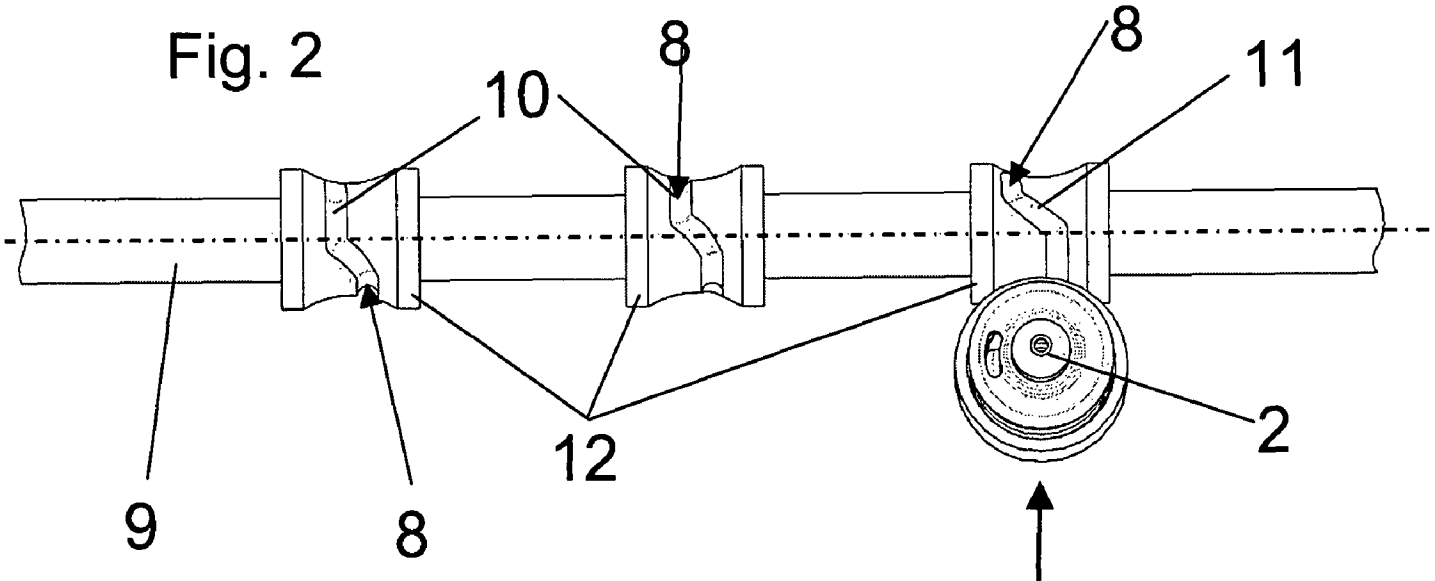
FIG. 2 shows a top view according to FIG. 1.

FIG. 2 shows a top view of adjustment shaft 9 with multiple sleeves 12 disposed on it, for switching activation of multiple valve play equalization elements 1 disposed in series, whereby only one valve play equalization element 1 is shown, for reasons of clarity. The arrangement of groove 8 can be seen particularly well in FIG. 2; it consists of radial groove sections 10 and groove section 11 that demonstrates an axial incline. As described above, groove 8 can also be disposed directly on the circumference of adjustment shaft 9. To rotate switching ring 5 and thus to activate valve play equalization element 1, adjustment shaft 9 is rotated in controlled manner. Adjustment shaft 9 can be rotated in both directions, thereby implementing locking and unlocking of housing 4 of valve play equalization element 1 relative to a guide 3 disposed in it in an axially displaceable manner.

Figure 3:
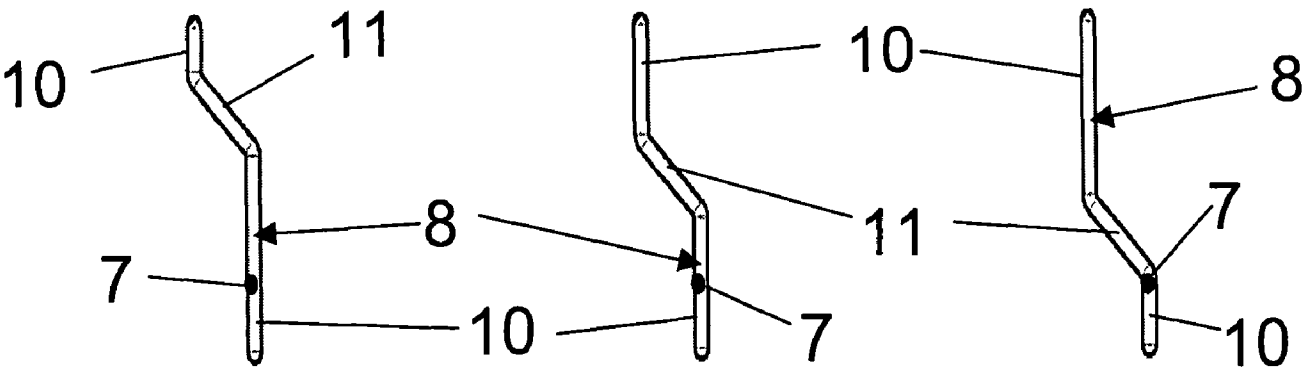
FIG. 3 shows a developed view of the grooves of the adjustment shaft that are connected with a guide element.

The arrangement shown in FIG. 2 serves for turning multiple valve play equalization elements 1 disposed in a series, for a cylinder row or a cylinder block, on or off. This can involve a four-cylinder inline engine in which one, two, or three cylinders can be shut off. The solution according to the invention can be used in accordance with the configuration of the engine. According to FIG. 2, linkage 13 of a valve play equalization element 1 is in communication with a groove 8 of the adjustment shaft 9 or sleeve 12, by way of a related guide element 7. In FIG. 2, the individual groove sections 11 that demonstrate an axial incline are disposed on the circumference of adjustment shaft 9 or sleeve 12, offset relative to one another. FIG. 3 shows a developed view of the individual grooves 8, in which the offset of groove sections 11 relative to one another can be seen. In FIG. 3, the positions of guide elements 7 in grooves 8 can also be seen. Due to the offset of groove sections 11 that demonstrate an axial incline, in the event of a rotation of adjustment shaft 9, seen in the direction of valve play equalization element 1, individual switching rings 5 of valve play equalization element 1 are adjusted, one after the other.

If guide element 7 of valve play equalization element 1 shown on the right in FIG. 2 is situated at the transition of groove section 10 to groove section 11—as shown in FIG. 3—guide element 7 of valve play equalization element 1 disposed on the right passes through groove section 11 when adjustment shaft 9 is rotated by a corresponding angle. As a result, as described above, switching ring 5 of valve play equalization element 1 is rotated, thereby causing the support function of valve play equalization element 1 to be shut off. Adjustment shaft 9 is turned so far that guide element 7 has passed through groove section 11 and is now situated in the entrance region of the subsequent groove section 10. The guide elements 7 of the central and the left valve play equalization element 1 have each passed through the radially disposed groove section 10 during the setting process. Rotation of switching rings 5 of the central and the left valve play equalization element 1 did not take place in this connection. Guide element 7 of central valve play equalization element 1 is now situated directly in front of groove section 11. By further rotation of adjustment shaft 9 in the same direction, shut-off of the central valve play equalization element 1 takes place. By rotation of the adjustment shaft 9 in the opposite direction, switching ring 5 is rotated in the opposite direction, thereby re-activating the valve play equalization element 1 that was last shut off. Thus, turn-on and shut-off of the individual valve play equalization elements 1 takes place using simple means.

The sequence of the placement of the individual grooves 8 on sleeves 12 shown in FIG. 3 can be configured differently, depending on the requirements. In this connection, grooves 8 can be disposed in such a manner that when adjustment shaft 9 is rotated in the same direction, first the right, then the left, and finally the central valve play equalization element 1 is shut off.

It is also possible that three valve play equalization elements 1 of a four-cylinder inline engine or a cylinder bank of a V6 engine are supposed to be turned on or off at the same time. In this connection, the individual groove sections 11 that demonstrate an axial incline lie on the circumference of adjustment shaft 9 or sleeve 12, in the same axial plane.

It is also possible for groove 8 to be disposed circumferentially on the circumference of adjustment shaft 9 or sleeve 12. In this connection, each groove 8 has not only the radial groove sections 10 but also two groove sections 11 that demonstrate an axial incline, whereby the groove sections 11 are separated by a radial groove section 10. The incline of the two groove sections 11 is disposed in opposite directions, so that a circumferential groove is formed. In this way, it is possible to operate adjustment shafts 9 to turn on and turn off the individual valve play equalization elements 1 in only one direction of rotation. Reversal of the switching takes place after all the valve play equalization elements 1 have previously been shut off. If reversal of switching is required, shut-off of the valve play equalization elements 1 that have not yet been shut off can take place during a valve play.

Accordingly, while only a few embodiments of the present invention have been shown and described, it is obvious that many changes and modifications may be made thereunto without departing from the spirit and scope of the invention.

LISTING OF REFERENCE SYMBOLS USED

1 valve play equalization element
2 support piston
3 guide
4 housing
5 switching ring
6 switching ball
7 guide element
8 groove
9 adjustment shaft
10 radial groove section
11 groove section demonstrating an axial incline
12 sleeve
13 linkage
14 bore

What is claimed is:

1. A device for switching activation of a hydraulic valve play equalization element for optional setting of a maximal stroke or a zero stroke on a valve of an internal combustion engine, comprising:

a switching element for locking and unlocking a housing of the valve play equalization element with regard to a guide that is axially displaceable within the housing, the switching element consisting of a rotatable switching ring surrounding the housing;

a linkage for rotating the switching ring relative to the housing, said linkage being disposed on the switching ring; and a rotatable adjustment shaft having a groove disposed on a circumference thereof, the groove having a groove section with an axial incline;

wherein the linkage is in communication with the groove by way of a guide element, and wherein the switching ring is rotated in the groove section via the guide element during rotation of the adjustment shaft to implement a switching process.

2. The device according to claim 1, wherein ends of the groove section that demonstrates an axial incline each make a transition into a radial groove section.

3. The device according to claim 1, wherein the incline of the groove section proportionally corresponds to an angle of rotation for rotating the switching ring.

4. The device according to claim 1, wherein the groove is disposed on the adjustment shaft or on a surface of a sleeve that is connected with the adjustment shaft.

5. The device according to claim 1, wherein the adjustment shaft can be adjusted in both directions of rotation, in a controlled manner.

6. The device according to claim 1, wherein the guide element is a ball.

7. The device according to claim 1, wherein the groove is disposed circumferentially on the circumference of the adjustment shaft or a sleeve surrounding the adjustment shaft, wherein each groove comprises two groove sections that demonstrate an axial incline, said groove sections being separated by a radial groove section, and wherein the axial incline of the two groove sections is disposed in opposite directions.

8. A system comprising multiple valve play equalization elements disposed in series along a single adjustment shaft, each valve play equalization element having a device for switching activation of the hydraulic valve play equalization element for optional setting of a maximal stroke or a zero stroke on a valve of an internal combustion engine, each device comprising:

a switching element for locking and unlocking a housing of the valve play equalization element with regard to a guide that is axially displaceable within the housing, the switching element consisting of a rotatable switching ring surrounding the housing;

and a linkage for rotating the switching ring relative to the housing, said linkage being disposed on the switching ring;

wherein the adjustment shaft has grooves corresponding to each linkage, said grooves being disposed on a circumference of the adjustment shaft and each groove having a groove section with an axial incline;

wherein each linkage is in communication with a corresponding groove by way of a guide element, and wherein the switching ring of each device is rotated in the groove section via the respective guide element during rotation of the adjustment shaft to implement a switching process for each valve play equalization element.

9. The system according to claim 8, wherein the individual groove sections that demonstrate an axial incline are disposed offset relative to one another on the circumference of the adjustment shaft or on a sleeve surrounding the adjustment shaft, to turn each valve play equalization element on or off one after the other.

10. The system according to claim 8, wherein the individual groove sections that demonstrate an axial incline on each device lie in a same axial plane on the circumference of the adjustment shaft or on a sleeve surrounding the adjustment shaft, to turn on or shut off of the multiple valve play equalization elements simultaneously.

11. The device according to claim 8, wherein a sequence of turn-on or shut-off of the individual valve play equalization elements disposed in series can be controlled by arrangement of the offset of the individual groove sections on the adjustment shaft or on a sleeve surrounding the adjustment shaft.

* * * * *